US005103523A

United States Patent [19]

Drago et al.

[11] Patent Number: 5,103,523

[45] Date of Patent: Apr. 14, 1992

[54] BRIDGE HAVING A MODULAR STRUCTURE AND A LAUNCHING METHOD FOR THE INSTALLATION THEREOF

[76] Inventors: Giuseppe Drago, Via Monte 37, 39057 Appiano (Bolzano); Paolo Drago, Via San Quirino 46, 39100 Bolzano, both of Italy

[21] Appl. No.: 631,320

[22] Filed: Dec. 21, 1990

[51] Int. Cl.[5] ..... E01D 15/12; E01D 5/00

[52] U.S. Cl. ..... 14/2.4; 14/6

[58] Field of Search ..... 14/2.4, 6, 2.1

[56] References Cited

U.S. PATENT DOCUMENTS

| | | | |
|---|---|---|---|
| 2,556,175 | 6/1951 | Frost | 14/2.4 |
| 3,034,162 | 5/1962 | Smith | 14/2.4 X |
| 3,783,573 | 1/1974 | Vaughan | 14/14 X |
| 4,521,932 | 6/1985 | Parramore | 14/2.4 |
| 4,663,793 | 5/1987 | Parramore | 14/2.4 |
| 4,665,577 | 5/1987 | Parramore | 14/2.4 |
| 4,853,992 | 8/1989 | Bernard et al. | 14/2.4 |
| 4,920,595 | 5/1990 | Fussinger et al. | 14/2.4 |
| 4,962,556 | 10/1990 | Helmke et al. | 14/2.4 |
| 5,042,101 | 8/1991 | Hoether | 14/2.4 |

*Primary Examiner*—Ramon S. Britts
*Assistant Examiner*—Nancy P. Connolly
*Attorney, Agent, or Firm*—Sughrue, Mion, Zinn, Macpeak & Seas

[57] ABSTRACT

The bridge includes a plurality of foldable portions or modules (M) interconnectible releasably in sequence longitudinally. Each module (M) includes a central deck member (9) and two lateral deck members (10, 11) articulated to opposite sides of the central deck member (9). Respective longitudinal beams (13–16) extend from the lower faces of the lateral deck members (10, 11) and, together with the homologous beams of the other modules (M), constitute the load-bearing trusses of the bridge in its condition of use.

Conveniently, the bridge is constructed by a method of assembly which provides for the use of a load-bearing assembly structure or forestarling (S). This load-bearing assembly structure (S) is assembled in a position of assembly on a first side ($B_1$) of the gap (R) to be spanned by the bridge and is then advanced until it reaches the other side ($B_2$) of the gap. During a subsequent stage in the assembly of the bridge, the load-bearing assembly structure (S) supports a plurality of interconnected modules (M) and guides them for sliding until they reach the opposite side ($B_2$).

Upon completion of the assembly, the load bearing assembly structure or forestarling (S) is connected firmly to the structure formed by the modules (M) so as to contribute to the structural strength of the bridge.

19 Claims, 9 Drawing Sheets

BRIDGE HAVING A MODULAR STRUCTURE AND A LAUNCHING METHOD FOR THE INSTALLATION THEREOF

DESCRIPTION

The present invention relates to a bridge with a modular structure for military and civil uses More specifically, the invention relates to a bridge with foldable modules of the type including a plurality of modules releasably interconnectible longitudinally in sequence, particularly of the type defined in the introductory part of the appended claim 1.

A modular bridge structure of this type is described, for example, in the present Applicant's European patent application No. EP-A-290405.

In the bridge of the aforesaid European patent application, each module or portion includes two self-supporting deck structures which are articulated to each other. The bridge forms a road surface with a carriageway of fairly limited width. The largest gap which can be bridged by a single span of this bridge is also limited.

The object of the present invention is to provide a modular bridge of the aforesaid type, the modules of which can form a road surface with a wider carriageway and, in particular, a carriageway of the minimum width suggested by international military standards (STANAG) or wider, that is, 4.5 m or wider, whilst still having restricted dimensions compatible with the size-limits set by the prevailing standards (the highway code) relating to transportation by motor vehicles A further object of the invention is to provide a bridge with a modular structure, a single arch or span of which can bridge wider gaps (rivers, valleys, etc.) than was possible with conventional bridges.

According to the invention, this object is achieved by means of a bridge with a modular structure whose main characteristics are defined in the appended claim 1.

The invention also relates to a method of assembly for constructing the bridge.

Figure 1:
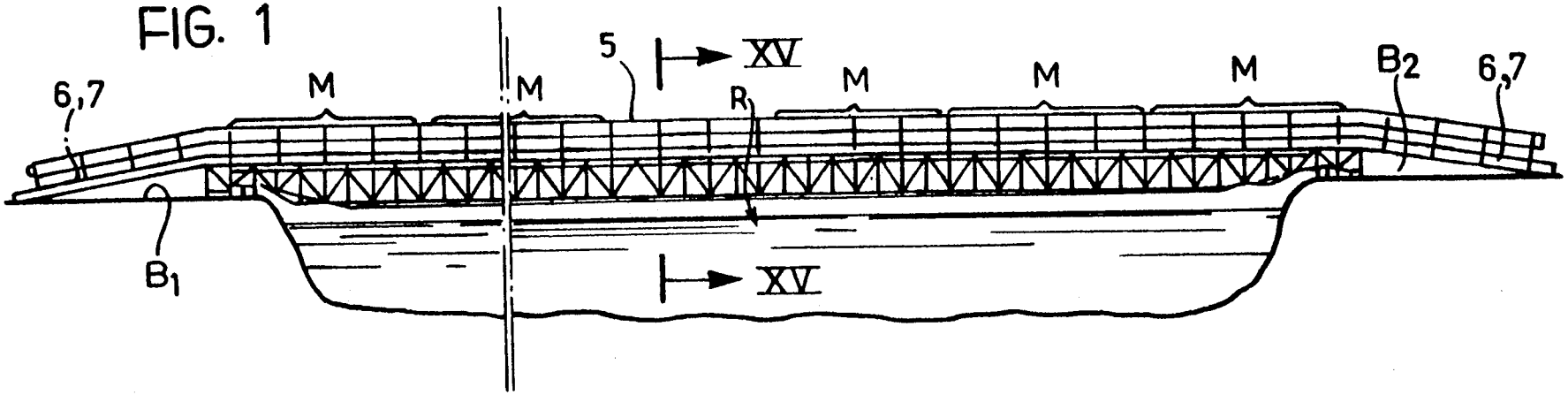
Figure 2:
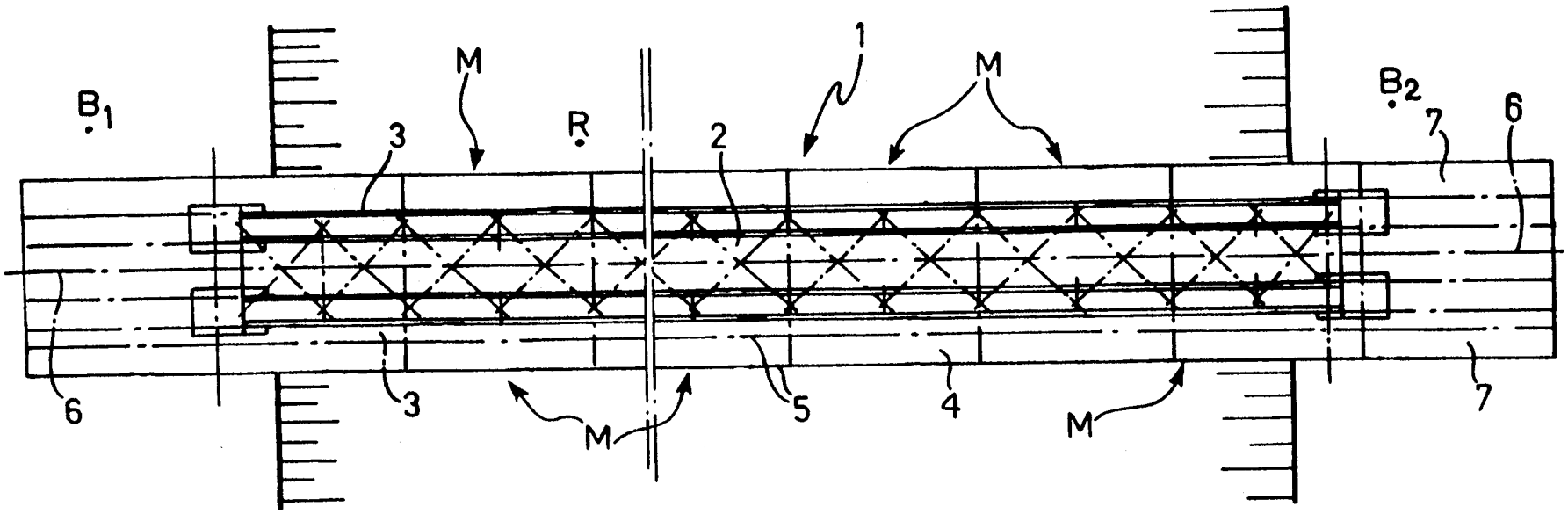
Figure 3:
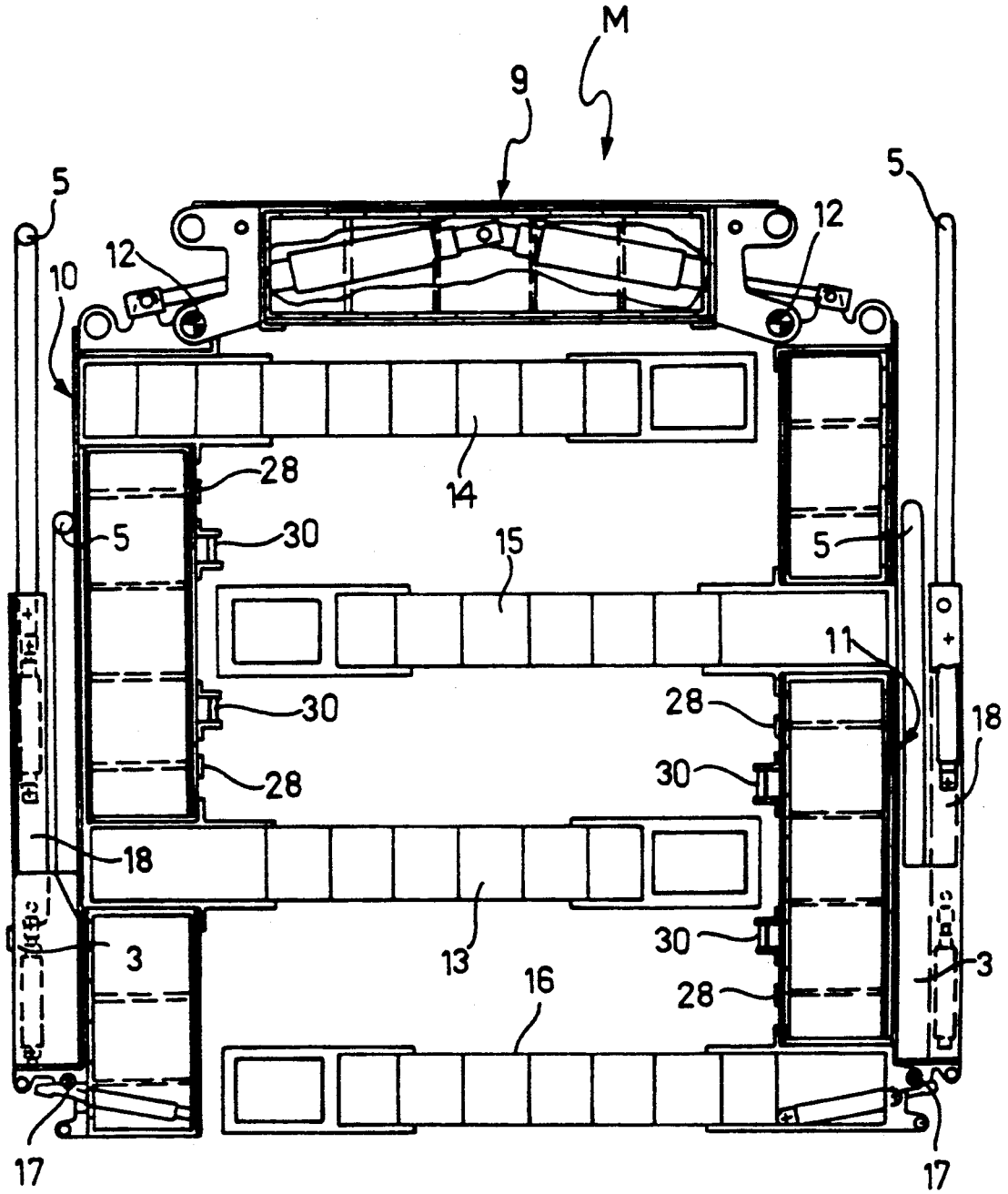
Figure 4:
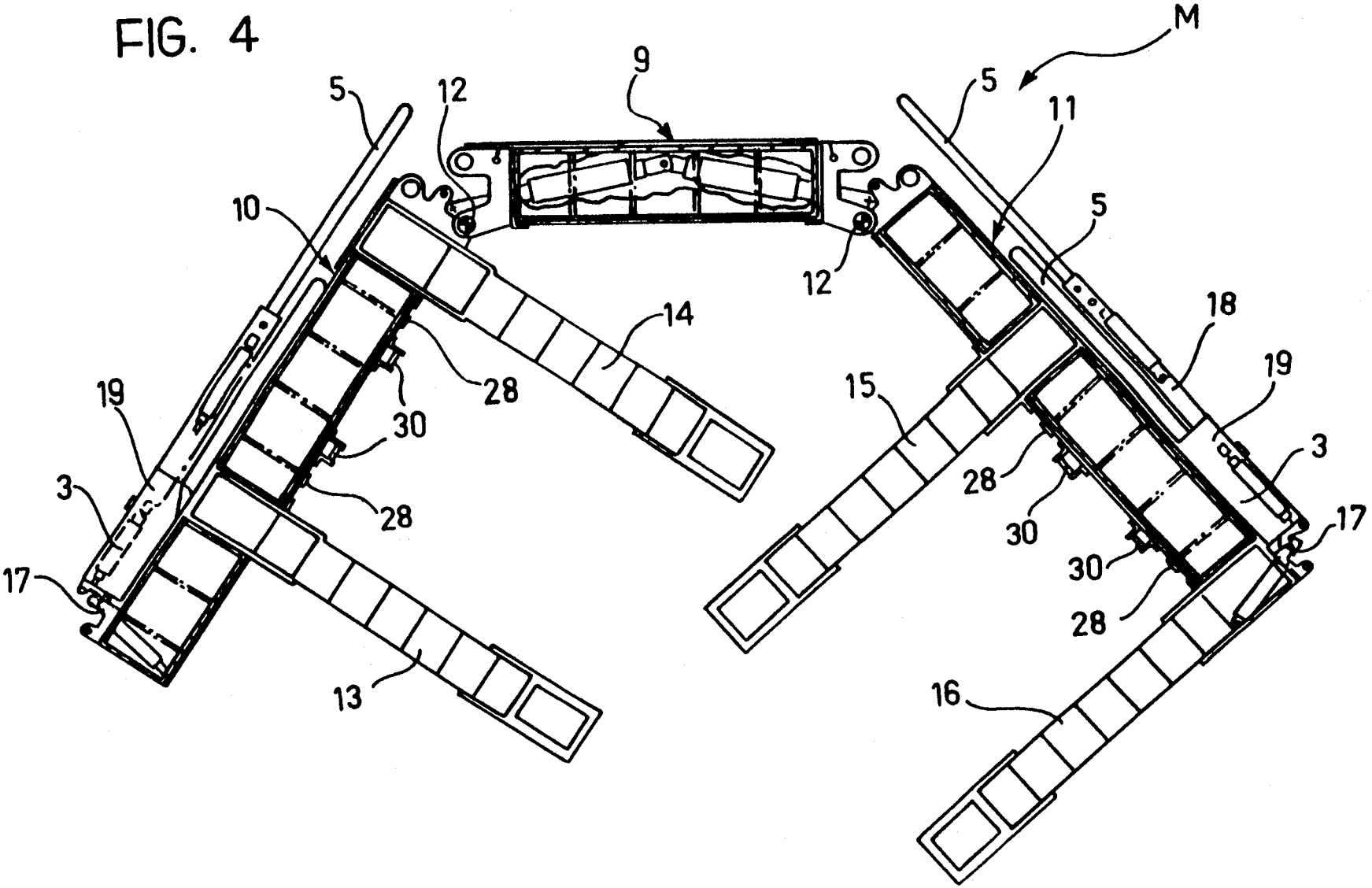
Figure 5:
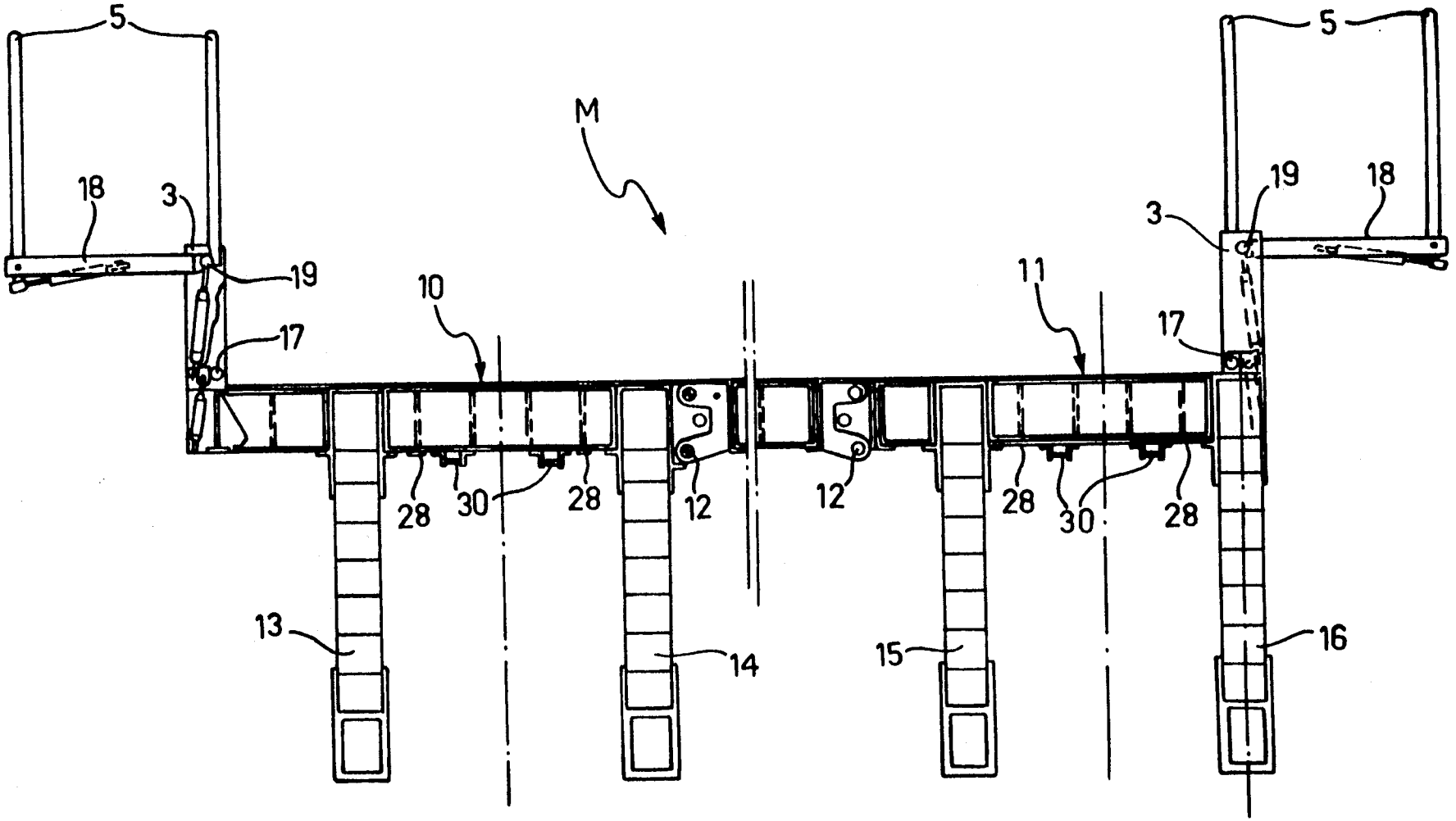
Figure 6:
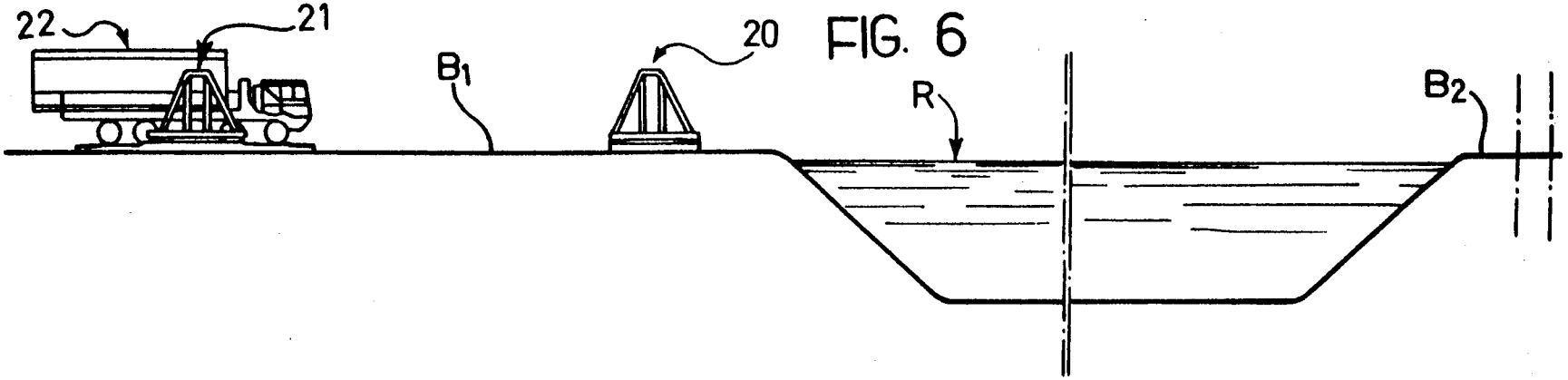
Figure 14:
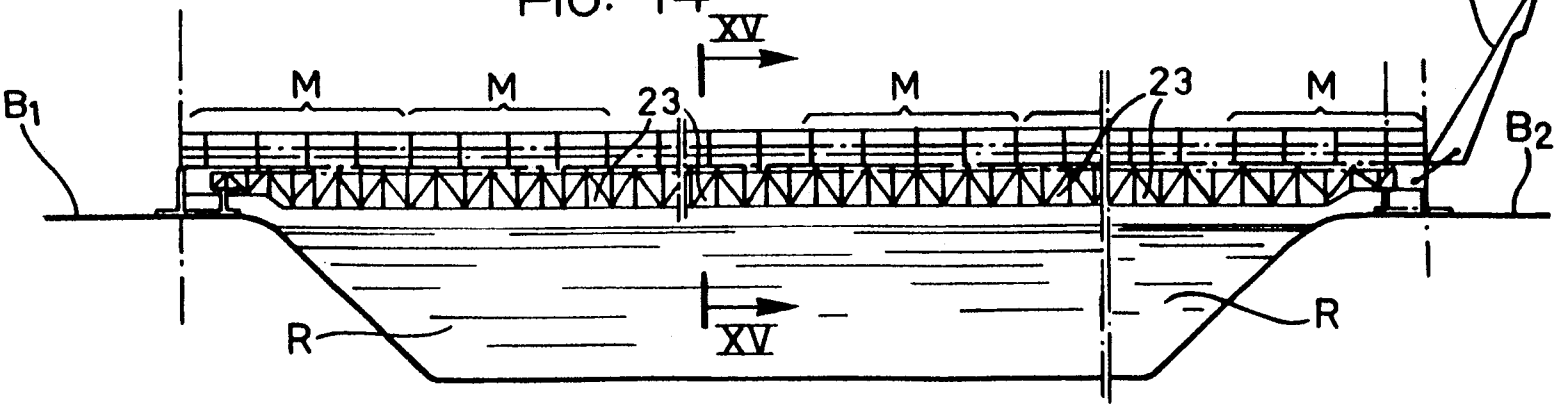
Figure 7:
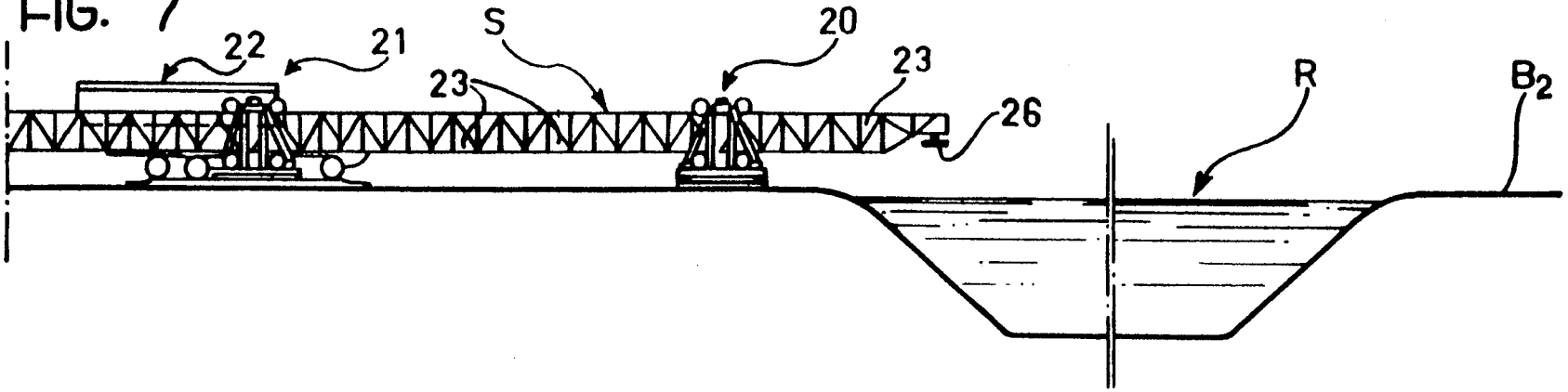
Figure 8:
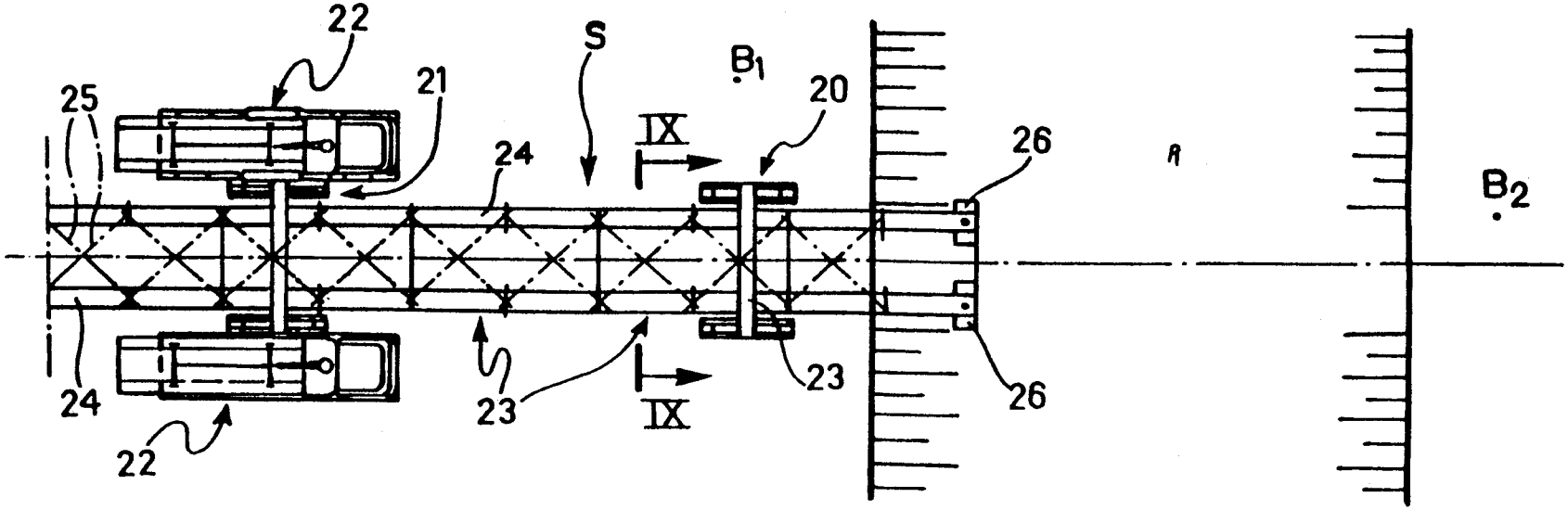
Figure 10:
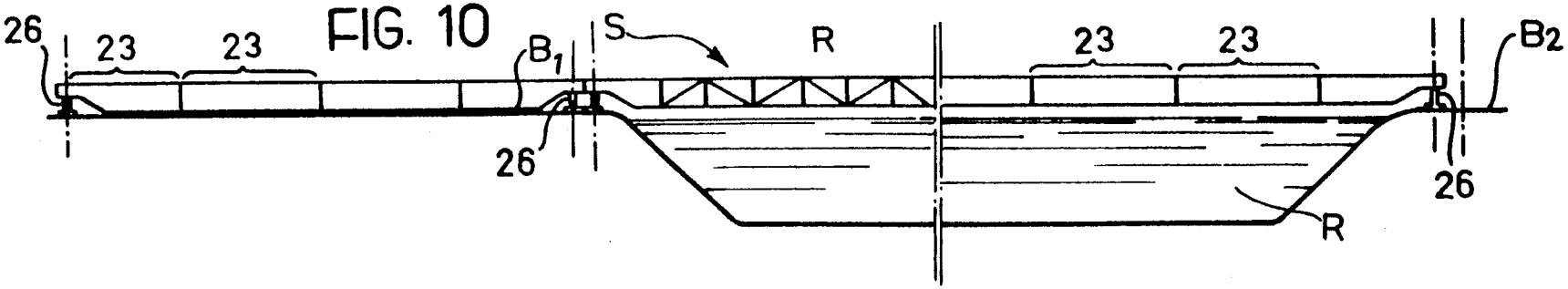
Figure 11:
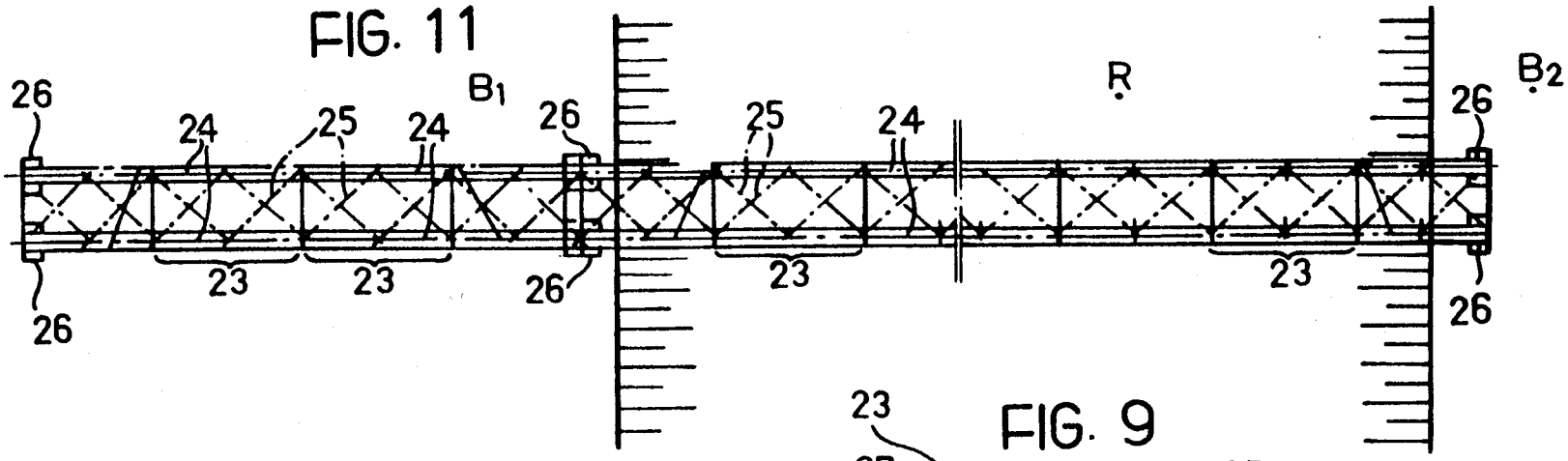
Figure 9:
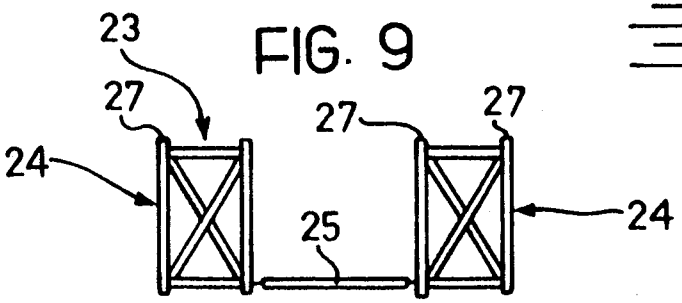
Figure 12:
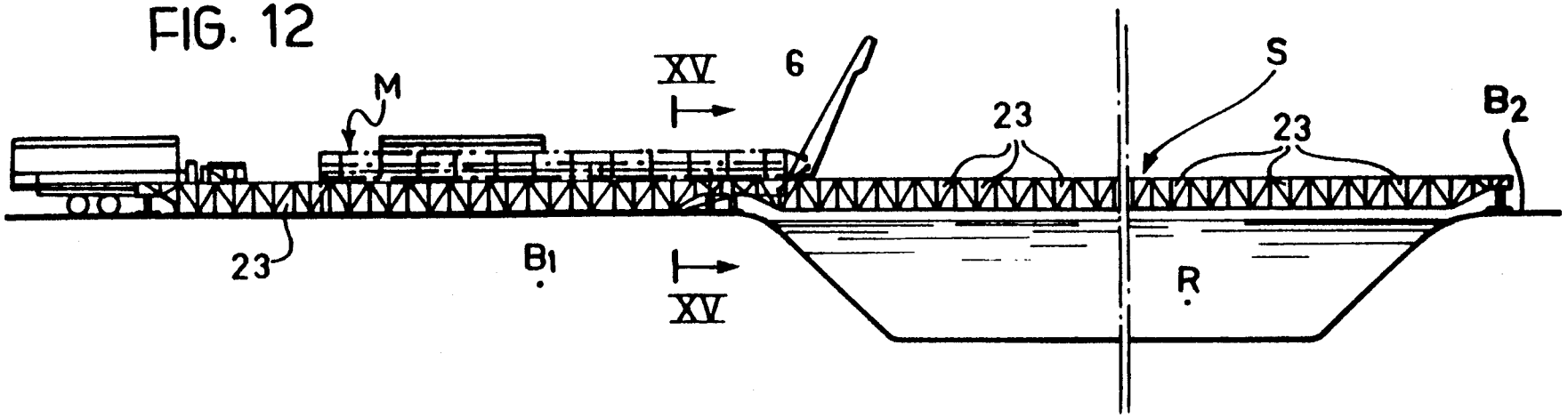
Figure 13:
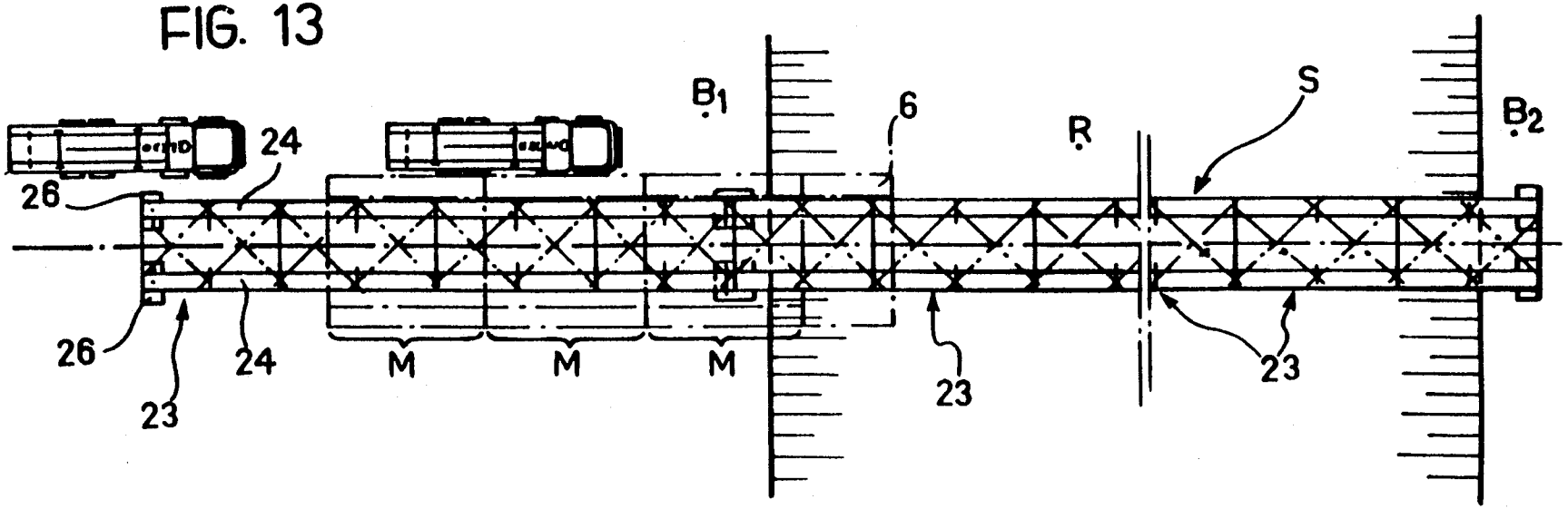
Figure 15:
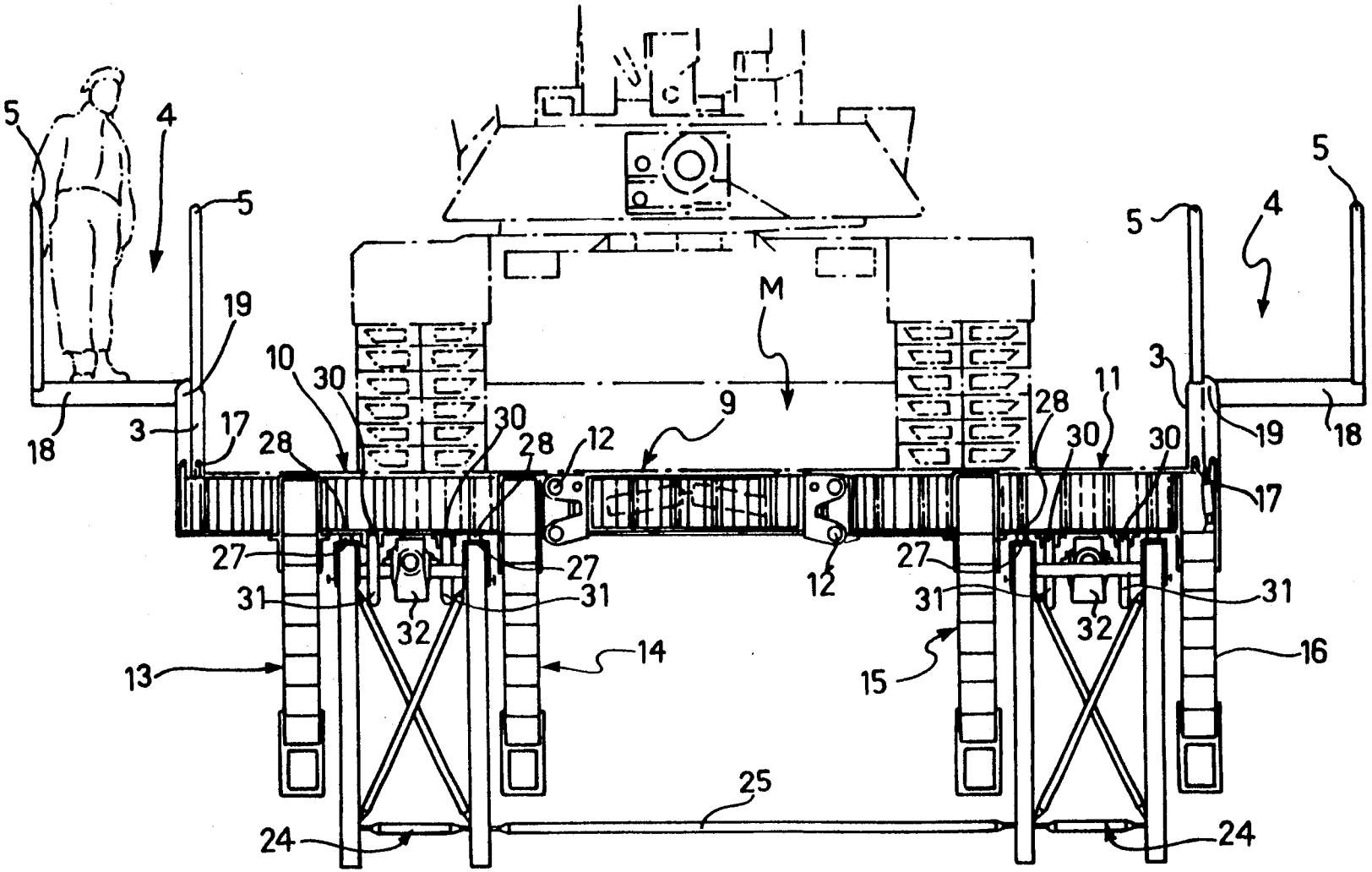

Further characteristics and advantages of the invention will become clear from the detailed description which follows with reference to the appended drawings, provided purely by way of non-limiting example, in which:

FIGS. 1 and 2 are a side view and a plan view, respectively, of a bridge formed according to the present invention, FIG. 3 shows one portion or module of a bridge according to the invention in its folded condition for storage or transportation, FIG. 4 shows one portion or module or the bridge at a stage during its unfolding for construction, FIG. 5 shows a module of the bridge in the unfolded condition, FIGS. 6 and 7 are schematic side views of an assembly station for constructing the bridge, in two successive stages of its operation, FIG. 8 is a view of the assembly station of FIG. 7 from above, FIG. 9 is a section taken on the line IV—IV of FIG. 8, FIGS. 10 and 11 are a side view and a view from above showing the assembly station in an advanced stage of the setting up of a load-bearing assembly structure or forestarling, FIGS. 12 and 13 are views from the side and from above of the assembly station at a subsequent stage in the construction of the bridge, FIG. 14 is a side view of the bridge almost complete, and FIG. 15 is a section taken on the line XV—XV of FIG. 1, on a considerably enlarged scale.

In FIG. 1, a modular bridge structure, indicated 1, is formed by the connection of a plurality of portions or modules M which are releasably interconnected in sequence longitudinally, for example, by means of bolted connecting plates. The bridge shown extends between the two sides or banks $B_1$ and $B_2$ of a river R.

As can be seen in particular from FIG. 2, in the embodiment shown by way of example, the bridge 1 includes a central road surface 2 delimited at the sides by two shoulders or side pieces 3. Beside the road surface 2, the bridge also has two pedestrian walkways 4 whose parapets are indicated 5.

The road surface 2 has access ramps 6 at its ends.

Access ramps 7 with parapets are also connected to the ends of the pedestrian walkways 4 (FIG. 2).

The structure of a single module or portion of the bridge according to the invention will now be described in greater detail.

With reference to FIGS. 3 to 5, a module or portion M includes a central deck member 9 and two lateral deck members 10, 11 constituted, for example, by substantially rectangular box structures. The lateral deck members 10, 11 are articulated to the central deck member 9 by permanent hinged joints 12 along axes parallel to the longitudinal axis of the bridge 1 in its assembled condition.

Respective pairs of longitudinal beams 13, 14 with lattice structures (as in the embodiment illustrated) or box structures extend from the lower faces of the lateral deck members 10 and 11.

The beams 13 and 14 of the deck member 10 are offset transversely relative to the beams 15 and 16 of the other lateral deck member 11.

The deck members of each module M can assume a folded, compact condition, shown in FIG. 3, for storage or transportation and an unfolded condition of use, shown in FIG. 5, in which they are substantially coplanar and together form a portion of the road surface of the bridge. The deck members can be locked in their unfolded positions of use by the engagement of pins or similar locking means in respective eyes which, with the pins, form releasable fastenings.

In the folded, storage or transportation condition, the deck members 9 to 11 are in a substantially U-shaped arrangement with the beams 13 to 16 extending inwardly of the U in alternating offset positions and lying substantially parallel to the plane of the central floor member 9.

In the unfolded condition of use of the bridge (FIGS. 5 and 15), the longitudinal beams 13 to 16 are rigidly connected to the homologous beams of the adjacent sections or modules M and constitute the load-bearing framework of the bridge. The two pairs of longitudinal beams thus formed annul the effects of torsion on the bridge when it is loaded eccentrically.

Each module or portion of the bridge also includes two side pieces 3 which act as wheel fenders and are each articulated to a respective lateral deck member adjacent the side thereof opposite the central deck member 9.

The side pieces 3 on the same side of adjacent modules M of the bridge can be interconnected rigidly (by known means) so as to form continuous side pieces.

The side pieces 3 are also articulated to the lateral deck members 10, 11 by permanent hinged joints, indicated 17, and can assume lowered positions for storage or transportation, shown in FIG. 3, and erect positions of use, shown in FIG. 5. In the latter positions, the side pieces 3 extend substantially perpendicular to the road surface formed by the deck members 9–11.

The side pieces 3 may also conveniently be locked in their erect positions of use by pins which engage fastening eyes in the side pieces and corresponding fastening eyes near the outer sides of the lateral deck members 10 and 11.

Each side piece 3 is articulated to the respective lateral deck member 10 or 11 in such a manner that, when the module M is in the folded condition (FIG. 3), the side piece 3 lies adjacent the upper surface of the lateral deck member outside the U-shape (or inverted U-shape) formed by the deck members of the module.

Each module or portion M also includes a pair of gangways 18 for forming, with the corresponding parts of adjacent modules, the pedestrian walkway 4 mentioned above. The gangways 18 are articulated to the side pieces 3 at 19 and can assume closed positions (FIG. 3) in which they lie substantially adjacent the associated lateral deck members 10 and 11. In their unfolded positions of use (FIGS. 5 and 15) the gangways 18 are perpendicular to the side pieces 3 and hence parallel to the road surface.

As can be seen from FIGS. 3 to 5, in each module, two parapets or railings 5 are associated with each gangway 18, one railing being fixed to the associated side piece 3 and the other being articulated to the gangway 18. When the module is in the folded, storage or transportation condition, the parapets or railings 5 are arranged in the manner shown in FIG. 3.

Each module M may conveniently be made of steel, aluminium, light-metal alloy, or even a composite synthetic material.

Conveniently, the lateral deck members 10 and 11 are wider (transversely) than the central deck member 9, as can be seen in FIGS. 3 to 5 and 15. In particular, the lateral deck members are preferably about 1.5 times as wide as the central deck member.

This dimensional relationship enables the modules of the bridge according to the invention to form road surfaces with carriageways 5 m wide or possibly even wider. By virtue of the particular structure described above, the size of each module in its folded, storage and transportation condition is nevertheless compatible with the size-limits prescribed for transportation on motor vehicles.

A system of assembly for constructing the bridge according to the invention will now be described with reference to FIGS. 6 to 15.

With reference to FIG. 6, an assembly position with two roller stands or portals 20 and 21 of known type aligned in the direction in which the bridge is to extend is first prepared adjacent a bank $B_1$ of the gap to be bridged by the bridge. The stand 21 furthest from the bank is suitably counterweighted, for example, by means of two ballasted vehicles 22 (see FIG. 8).

In order to construct the bridge, a launching or load-bearing assembly structure or forestarling, generally indicated S in FIGS. 6 to 11, is assembled beforehand. This structure is also conveniently constituted by a plurality of modular units 23 connected releasably but rigidly in sequence longitudinally.

As can be seen in FIGS. 8, 9, 11 and 13, each module 23 of the load-bearing assembly structure S includes two lattice trusses 24 of substantially rectangular cross-section connected at their lower sides by rods 25.

As the load-bearing assembly structure is assembled, it is passed through the roller stands 20 and 21 of the assembly position (FIG. 7). As further modular units 23 are added to the load-bearing assembly structure, it is advanced further towards the bank $B_2$.

The load-bearing assembly structure is formed by a larger number of modular units than is strictly necessary to span the river R: as can be seen in FIG. 10, the structure also includes a certain number of modular units 23 in the assembly station on the bank $B_1$.

Once the load-bearing assembly structure S has reached the bank $B_2$, it is levelled in known manner, for example, by the operation of feet 26 adjustable manually or by hydraulic or electrical systems.

The stands 20, 21 and their associated rollers are then removed.

Conveniently, as can be seen in FIG. 15, the widths of the lattice trusses 24 of the load-bearing assembly structure S are such as to enable them to be inserted respectively between the beams 13, 14 and 15, 16 of a module M which has been unfolded for construction.

As can be seen particularly in FIGS. 9 and 15, strips or blocks 27 having a low coefficient of friction based, for example, on polytetrafluoroethylene (Teflon) or nylon, are provided on the upper rails of the lattice trusses 24 of the load-bearing assembly structure.

Unfolded modules M are then positioned astride the modules 23 of the load-bearing assembly structure which are supported on the bank $B_1$, as can be seen, in particular, in FIGS. 12 to 15.

Two strips or blocks 28 of material with a low coefficient of friction are provided on the lower face of each lateral deck member 10 or 11 of each module M in relative positions corresponding to those of the strips or blocks 27 of the lattice trusses 24 of the forestarling.

As shown in FIGS. 12 and 13, the modules M are unfolded one by one, arranged astride the lattice trusses 24 of the load-bearing assembly structure, and connected to each other longitudinally.

Conveniently, respective longitudinal rack portions 30 are fixed to the lower face of the deck members 10 and 10, of each module M and are engaged by sprockets 31 of geared drive units 32 provided as appropriate on at least some of the modular elements 23 constituting the load-bearing assembly structure S (FIG. 15). The geared drive units may be operated hydraulically, electrically or manually and their operation can move the modules M along the lattice trusses 24 of the assembly structure, their sliding being facilitated by the engagement between the strips or blocks 27 of the trusses and the corresponding strips or blocks 28 of the modules M.

The modules M assembled one by one on the assembly structure S are thus gradually moved towards the bank $B_2$.

Assembly continues until the structure formed by the modules M reaches the bank $B_2$.

The modules 23 of the load-bearing assembly structure S which were used as an assembly platform on the bank $B_1$ are then disconnected and removed. The remaining assembly structure S, which extends between the two banks of the river R is then connected rigidly to the beams 13 to 16 of the structure formed by the modules M and is left in position so that it contributes to the structural strength of the bridge.

Finally, the structure thus formed is provided with access ramps at its ends.

In order to dismantle the bridge described above, the steps carried out to assemble it are effected in reverse; the access ramps are removed, modular service units 23 are added to the load-bearing assembly structure S on one bank of the river and the recovery of the modular elements M then starts with their translation along the structure S by the geared drive units carried by the lattice trusses 24. Once the modules M have been recovered, assembly stands are set up on one bank of the river and the modular units 23 which constituted the load-bearing assembly structure are recovered.

Naturally, the principle of the invention remaining the same, the forms of embodiment and details of construction may be varied widely with respect to those described and illustrated purely by way of non-limiting example, without thereby departing from the scope of the present invention.

We claim:

1. A bridge with a modular structure including a plurality of modules interconnectible releasably in sequence longitudinally and each including deck members articulated to each other along axes parallel to the longitudinal axis of the bride in the assembled condition, each module being adapted to assume a folded condition for storage or transportation and an unfolded condition of use in which the deck members are coplanar and together form a portion of the road surface, wherein each module includes a central deck member, two lateral deck members articulated to opposite sides of the central deck member, and respective longitudinal beams extending from the lower faces of the lateral deck members and together with the corresponding beams of the other modules, constituting load-bearing trusses in the condition of use of the bridge, the deck members being in a substantially U-shaped arrangement in the folded condition, with the beams extending inwardly of the U in respective offset positions so that, when the module is folded, the beams of one lateral deck member are offset vertically with respect to those of the other lateral deck member, each beam being parallel to the central deck member.

2. A bridge according to claim 1, wherein a pair of parallel beams extends from each lateral deck member in a position such as to be offset transversely relative to the beams of the other lateral deck member so that, when the module is folded, the beams of one lateral deck member alternate with those of the other lateral deck member.

3. A bridge according to claim 1, wherein the lateral deck members are wider than the central deck member.

4. A bridge according to claim 3, wherein the lateral deck members are about 1.5 times wider than the central deck member.

5. A bridge according to claim 1, wherein the beams have lattice structures.

6. A bridge according to claim 1, wherein the beams have box structures.

7. A bridge according to claim 1, wherein each module also includes two side pieces, each of which is articulated to the outer longitudinal side of a respective lateral deck member.

8. A bridge according to claim 7, wherein each side piece is articulated to the respective lateral deck member in such a way that, when the module is in the folded condition, the side piece lies adjacent the upper surface of the lateral deck member outside the U-shape formed by the deck members of the module.

9. A bridge according to claim 8, wherein a gangway is articulated to at least one side piece of each module for forming, with the corresponding gangways of adjacent modules, the walking surface of a pedestrian walkway adjacent the road surface, each gangway being able to assume a closed position in which it is substantially parallel to the side piece to which it is connected and an unfolded position of use in which it is substantially perpendicular to that side piece.

10. A bridge according to claim 9, wherein respective parapets are articulated to each side piece and to the associated gangway.

11. A bridge according to claim 1, wherein the deck members of each module are articulated to each other by permanent hinges.

12. A bridge according to claim 7, wherein the side pieces are articulated to the lateral deck members by permanent hinges.

13. A bridge according to claim 10, wherein the gangways, the parapets and the side pieces are articulated to each other by permanent hinges.

14. A bridge according to claim 1, wherein each module is made from a material selected from aluminium, steel, a light-metal alloy and a composite material.

15. A bridge according to claim 1, wherein each module has dimensions compatible with the size-limits prescribed for transportation on vehicles when it is in its folded condition.

16. A bridge according to claim 1, wherein it also includes a load-bearing assembly structure including two parallel lattice trusses interconnected at their lower sides and each constituted by a plurality of modular portions connectible releasably in sequence longitudinally, the load-bearing assembly structure being intended to be assembled in a position of assembly on a first side of the gap to be spanned by the bridge and then advance from the position of assembly until it reaches the other side of the gap, and being adapted, during a subsequent stage of the assembly of the bridge, to support a plurality of interconnected modules arranged with their lateral deck members and their respective paris of beams astride the trusses of the assembly structure and to guide them for sliding to the other side, the load-bearing structure being connected firmly to the structure formed by the modules upon completion of the assembly so that it contributes to the structural strength of the bridge.

17. A bridge according to claim 16, wherein respective strips or blocks with a low coefficient of friction are provided on each module and on the trusses of the assembly structure to facilitate the sliding of the modules along the trusses.

18. A bridge according to claim 17, wherein the blocks or strips with a low coefficient of friction are based on polytetrafluoroethylene or nylon.

19. A bridge according to claim 16, wherein each module has at least one longitudinal rack and the load-bearing assembly structure has drive means for engaging the racks on the modules in order to move the modules along the load-bearing assembly structure.

* * * * *